US005370546A

United States Patent [19]

Evanisko

[11] Patent Number: 5,370,546

[45] Date of Patent: Dec. 6, 1994

[54] LAMP HOLDER FOR COLD CATHODE FLUORESCENT LAMP

[75] Inventor: Jim Evanisko, Hasbrouck Heights, N.J.

[73] Assignee: National Cathode Corp., New York, N.Y.

[21] Appl. No.: 1,841

[22] Filed: Jan. 8, 1993

[51] Int. Cl.[5] ..... H01R 13/44

[52] U.S. Cl. ..... 439/226; 439/682

[58] Field of Search ..... 439/226–244, 439/682, 683

[56] References Cited

U.S. PATENT DOCUMENTS

| | | | |
|---|---|---|---|
| 2,136,057 | 11/1938 | Olshansky | 439/682 |
| 2,393,616 | 1/1946 | Reamer et al. | 439/243 |
| 2,673,335 | 3/1954 | Verdon | 439/682 |
| 3,436,716 | 4/1969 | Amis, Jr. | 439/232 |

*Primary Examiner*—Larry I. Schwartz

*Assistant Examiner*—Hien D. Vu

*Attorney, Agent, or Firm*—Schweitzer Cornman & Gross

[57] ABSTRACT

A molded ceramic housing has two compartments, one for receiving a cold cathode lamp electrode and the other for containing an electrical terminal connected to an electrode contact in the one compartment, the contact engaging the lamp electrode. A ceramic cap encloses the terminal compartment. A ceramic tube is attached to the housing aligned with an aperture in a housing side wall adjacent to the terminal. The tube provides a free air spacer of approximately 1.5 inches in one embodiment. PVC flexible corrugated greenfield tubing is secured in the tube conduit. An electrical power cable extends through the greenfield tubing into the housing and is connected to the terminal. The extended end of the greenfield tubing has a strain relief attached for connection to a rigid metal conduit through which the cable is passed during installation.

19 Claims, 3 Drawing Sheets

LAMP HOLDER FOR COLD CATHODE FLUORESCENT LAMP

BACKGROUND AND SUMMARY OF INVENTION

The present invention relates to improved lamp holders for fluorescent cold cathode lamps.

Cold cathode fluorescent lamps are well known to the art and comprise an elongated internally phosphor coated glass tube filled with one or more gases which when excited by an electrical signal form a plasma which causes the coating to fluoresce and to illuminate the environment.

In a cold cathode lamp, the tube, which is generally about one inch in diameter, is typically bent into different shapes and includes at its opposite ends right angle on perpendicular tubular electrode end sections. Each perpendicular section contains an electrode a portion of which comprises an external circular cylindrical metal sleeve over the extremity of the right angle section. The end of the sleeve terminates in a metal end cap. The metal sleeve and metal end cap are in electrical connection with the lamp internal cathode portion in the right angle lamp section and form a contact which is inserted into a mating lamp socket for energizing the lamp. These lamps operate at relatively high power and low temperature.

A lamp holder including a socket for the cold cathode lamps typically includes a ceramic housing having a cavity divided into a terminal section, including a terminal to which a power supply cable is electrically connected, and a socket section containing a U-shaped bronze contact with a resilient portion. The contact resiliently engages the metal sleeve releasably holding the lamp in place by friction and electrically connects it to the lamp electrode via the metal sleeve and end cap. The terminal is connected to the contact. The housing cavity is divided by a phenolic sheet member bonded in place.

The ceramic housing has an apertured wall. An end of an electrical cable is inserted into the cavity through the aperture and connected to the terminal. A ceramic housing cap is fastened over the terminal section after the cable is connected. This lamp holder may be installed by electrical contractors into building structures.

The above-described "slate-of-the art" configuration, however, is subject to potential problems when a contractor hooks up the cable to the terminal during installation in the field.

In the prior art lamp holder, an end of the cable and greenfield assembly are coupled to the lamp holder by loosely passing the greenfield and cable into the housing cavity. The cable wire is then attached to the terminal of the lamp holder by the contractor. The cable and greenfield at their opposite ends, which may be 30–40 feet or more in length, are connected to the remainder of the wiring system.

The present invention provides a solution to the problems and deficiencies of the prior art lamp holders. In accordance with an embodiment of the present invention, a new and improved lamp holder for a cold cathode fluorescent lamp having a pair of spaced electrodes comprises a ceramic housing including a plurality of side walls and a bottom wall defining a cavity therein, one of the walls having an aperture therethrough. An electrical contact is in the cavity for releasably electrically receiving one of the electrodes. A electrically conductive terminal is electrically connected to the contact, the terminal having a terminal portion adapted to receive in conductive contact an electrical wire, the terminal portion being adjacent to the aperture. A ceramic member is secured to the one apertured wall over the aperture, and it has a conduit dimensioned to receive and secure greenfield tubing therein. The ceramic member is dimensioned to mate with the one wall to enclose the aperture at the interface with the one member. The conduit is in communication with the aperture such that a cable contained within and extending from the greenfield tubing can extend into the cavity through the aperture.

In accordance with one preferred embodiment of the invention, the ceramic member is a tube, while in a second preferred embodiment, the ceramic member is secured to the one wall with an adhesive bonding medium.

In a third embodiment the conduit has a length sufficient to provide free air space to preclude electrical shock hazard at the distal end of the conduit when the terminal receives a current of at least about 100 milliamps at 15 kv.

In yet a further embodiment, a length of the greenfield tubing and a length of the cable are each disposed within the conduit and extend from the ceramic member. The cable includes a wire, one end of which is electrically connected to the terminal, the tubing being secured within the conduit to the ceramic member.

DESCRIPTION OF THE PREFERRED EMBODIMENTS

Figure 1:
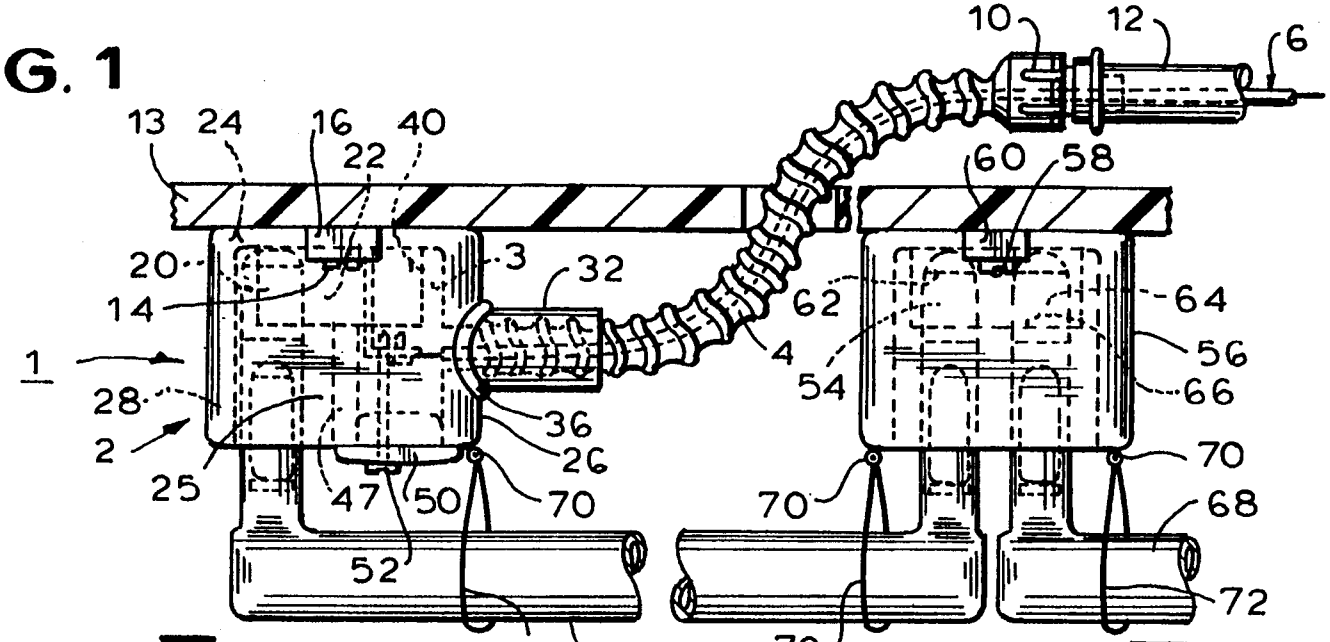
FIG. 1 is a side elevation view of an installed lamp holder according to one embodiment, of the present invention.
Figure 2:
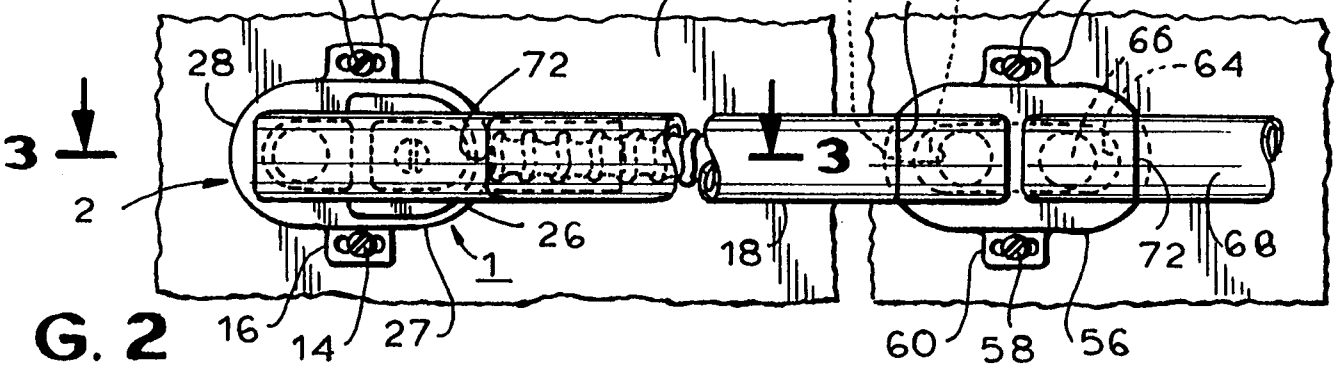
FIG. 2. is a plan view of the embodiment of FIG. 1 taken along lines 2—2.
Figure 3:
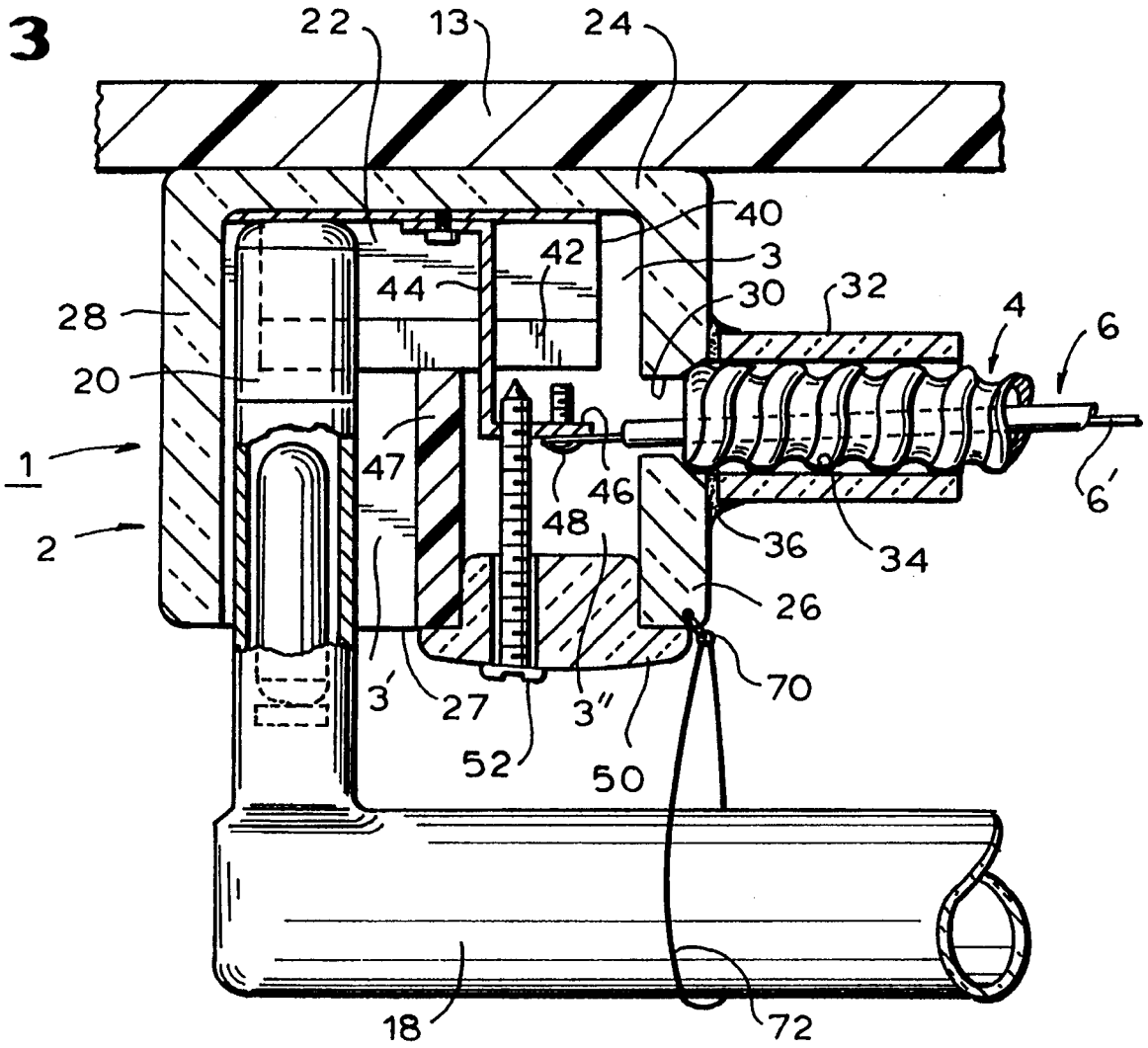
FIG. 3 is a detailed sectional elevation view of the lamp holder of FIG. 2 taken along lines 3—3.

In FIGS. 1, 2 and 3, an installed lamp holder 1 comprises a ceramic housing 2 having a cavity 3, a length, e.g., six inches, of flexible corrugated tubing 4 known as greenfield secured to the housing 2 and a relatively large length of an electrical cable 6, e.g., 40 feet, a portion of which extends through the greenfield tubing 4 into the cavity 3. The greenfield is preferably polyvinylchloride (PVC), but may be fabricated from other materials. A strain relief mechanism 10 is secured to an end of greenfield 4. The strain relief mechanism 10 is attached to an end of a length of rigid cable conduit 12 (only a portion of which is shown) which may be aluminum. The cable 6 is passed through the conduit 12 in a known way for attachment to a power source, e.g., a transformer (not shown).

The housing 2 is secured in the field to a support (e.g. ceiling) 13 by screws 14 via ceramic apertured flanges 16 integrally molded to housing 2. A cold cathode lamp 18 with an electrode 20 is inserted in and connected to the socket 22, to be described below, in cavity 3 of the lamp holder 1. Housing 2 comprises a planar bottom wall 24 with upstanding integrally molded side walls 25, 26, 27 and 28 which form cavity 3. The flanges 8 are coplanar with the bottom wall 24 in this embodiment. Opposing walls 26 and 28 are semicircular in plan view and opposing walls 25 and 27 are planar wherein cavity 3 is elongated with circular cylindrical end regions. An aperture 30, (FIG. 3) is formed in wall 26 in communication with cavity 3.

A molded ceramic tubular member 32, (FIG. 3,) has a conduit 34 at about the same diameter as that of aperture 30 and aligned therewith to form a continuous conduit. The member 32, at one end thereof, is bonded to the housing 2 preferably by an epoxy cement 36. The epoxy cement 36 is in the interface between the member 32 and housing 2 wall 26 and also forms an epoxy fillet around the joint between the member 32 and wall 26, securely attaching the member to the housing 2. In the alternative, the member 10 may be molded integrally with the housing 2. The tubular member 32 of conduit 34 has a preferably circular smooth wall whose diameter is chosen to closely receive the greenfield tubing 4.

The greenfield tubing is bonded to member 32 in conduit 34 with epoxy cement. This firmly secures the tubing 4 to the member 32. The tubing extends through the conduit 34 and abuts the housing 2 wall 26 in a recess therein. The tubing 4 is also bonded to the housing wall 26 with epoxy cement.

The member 32 importantly functions as a free air spacer. Free air space is the ambient atmosphere at the end of member 32, which member also provides a sufficient spacing of the cavity 3 from the ambient atmosphere along the length of cable 6. The cable 6 is rated for currents in the range of 100 milliamperes (ma) to 300 ma at a voltage of 15 kv. The cold cathode lamp 18 emits in excess of 400 lumens. To eliminate potential shock hazard at the extended end of the member 32 at these substantial power levels, the free air space of ambient atmosphere at the extended end is spaced from the cavity 3 a predetermined distance. In this embodiment, the conduit 34 and member 32 should have a minimum length of approximately 1.5 inches. The member 32, in this embodiment, has an outer diameter of approximately 0.75 inches and a conduit 34 diameter of approximately 0.5 inches. Preferably the greenfield has a length of approximately 6 inches from the member 32 so that the end of the strain relief mechanism 10 is approximately 9 inches from the center of housing 2.

Aside from the unique ceramic member 32, the remainder of the housing 2 and its internal components are presently commercially available, as will be understood by those skilled in the art. The available structures, however, suffer from the drawbacks discussed in the introductory portion hereinabove. The new member 32 not only provides a free air spacer, but also provides a support structure for the greenfield tubing 4 attached thereto and the strain relief attached to the tubing 4 to which the rigid conduit 12 is secured.

The cable 4 is part of the new and improved assembly of the present invention so that a contractor in the field need not enter into the housing 2 to attach the cable 4 to the terminal (to be described below) in the cavity 3. This is important because the lamp holder no longer serves as a component part of the system as in the prior art, but with the tubing 4 and cable 6 forms a complete subsystem of the electrical wiring system. This avoids the potential shock hazard of the electrician in the field attaching the cable to its terminal in the cavity 3 when the remote end of the cable may be coupled to a power source. In the arrangement of new lamp holder assembly, it is only when the extended end of cable 6 is attached to the power source that power may be applied to the lamp holder 1. Thus the attachment of the cable 6 to the power source is the final step in the installation, with the prior attachment of the housing 2 to a ceiling and the strain relief to the rigid conduit being the simple preliminarily (non-electrical) steps in installing the lamp holder 1. The new lamp holder therefore may be easily and quickly installed.

The lamp holder 1 has a U-shaped bronze contact forming a socket 40 frictionally secured to walls 25 and 27 in cavity 3 and abutting bottom wall 24. Socket 40 has outwardly bent upper side walls 42 which resiliently engage and lock to the walls 25 and 27 in a clutch-like action. The remainder of the socket 40 receives and resiliently engages an electrode 20 of the cold cathode lamp 18 inserted therein. An L-shaped bracket 44 has one leg riveted to the base of socket 40. A second leg 46 terminates adjacent to and aligned with an aperture 30 and a conduit 34 of tubing 32 to form a terminal. A screw 48 secures the copper center conductor 6' of the cable 6 to the second leg 46 of the terminal.

A phenolic sheet member 47 is epoxied to mating slots in walls 25 and 27 to divide cavity 3 into two compartments 3' and 3''. Compartment 3' receives the electrode portion of lamp 18 and compartment 3' contains the leg 46 terminal. A portion of the socket 40 lies at the base of compartment 3' for receiving and engaging the electrode 20 of lamp 18. A portion of the socket also lies in the base of the compartment 3''. The electrode 20 is firmly frictionally grasped by the socket 40 secure the electrode even when the lamp 18 is inverted as shown in the drawings. A ceramic cap 50 is secured over compartment 3'' by a nylon screw 52 threaded to leg 46 of the terminal.

The entire lamp holder 1 assembly comprising the housing 2, cable 6, and tubing 4 is portable, self contained, and requires no electrical connections to be made within the housing 2 by an electrician.

The installed system, requires an additional socket for electrically contacting a second electrode 54 of lamp 18, each lamp comprising a cold cathode electrode at opposite ends of the lamp. A second 56 is also fastened to the ceiling 13 via fasteners 58 and flanges 60 of lamp holder 56. The lamp holder 56 is similar to the structure of the lamp holder 1 except there is no L-shaped bracket and terminal in holder 56. Further, no cap 50 or screw 52 is used in holder 56. The socket 40 which extends into both compartments 3' and 3'' serves in this form as a socket for two electrodes. One socket 62 receives electrode 54 of lamp 18 and the other socket 64 receives electrode 66 of lamp 68. The system may continue with additional lamps and sockets for as many lamps as desired or deemed necessary for a particular lightly application.

Over long periods of time, the bronze socket 40 may lose some of its resiliency, become stiffer, and possibly reduce its grip on the retained lamp electrode. In such a situation, where the lamps are suspended beneath the lamp holders, gravity may tend to separate the lamps from their holders. To preclude lamp separation a safety cord is provided. In FIGS. 1, 2 and 3, an eyelet 70 is threaded to the housing 2 at its extended lip. A cord 72 is tied to eyelet 70 and wrapped about the lamp 18. A similar arrangement is provided to each housing of the lamp holders of the system. As will be understood, the cords 72 act as a safety net retaining the lamps in their sockets.

Figure 4:
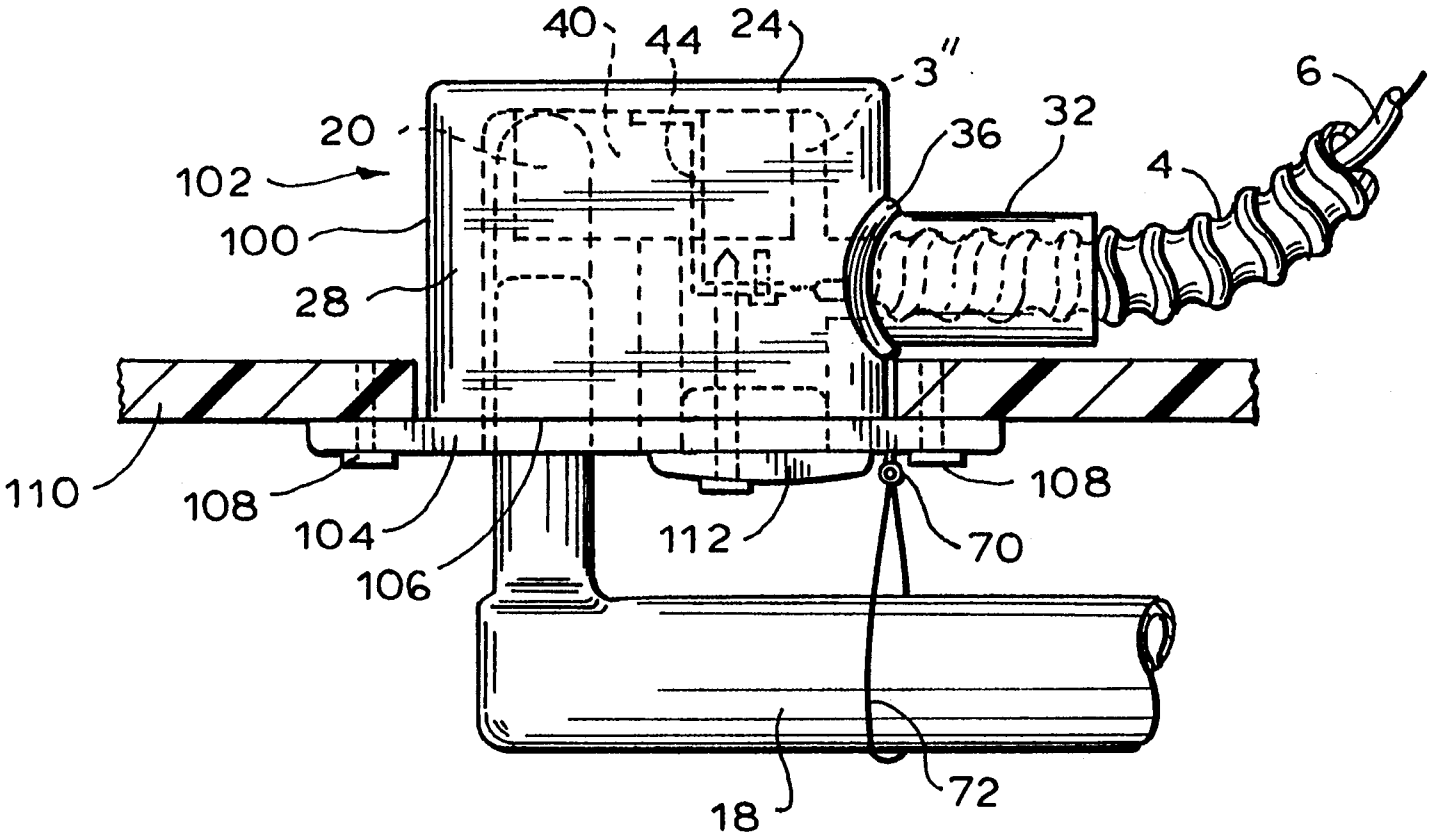
FIG. 4 is a side elevation view similar to that of FIG. 1 of a second embodiment of an installed lamp holder according to the present invention.

In FIGS. 1 and 2, the flanges 16 for securing the lamp holder to a ceiling 13 are at the base region of housing 2. In this embodiment the housing 2 extends below the ceiling. However, in FIG. 4, an alternate arrangement is shown for recessing the housing 100 of lamp holder 102 above the ceiling. A ceramic flange 104 is molded to the housing 100 lip 106. The flange 106 has apertures for receiving mounting screws 108 for securing the assembly to ceiling 110. Cap 112 is threaded over flange 104 and over the compartment 3" therebeneath. The remainder of lamp holder 102 is identical to the lamp holder 1 of FIGS. 1, 2 and 3.

As an alternative to bonding the greenfield to the tubular member 32 conduit 34, the conduit 34 may be molded with a spiral groove dimensioned to spirally receive the greenfield forming a molded corrugation in the internal conduit of the member 32. The mating corrugations of the greenfield slidably enter the conduit 34 and engage the molded member corrugations by rotating the greenfield tubing. This is possible because the greenfield tubing is relatively short, i.e., a few inches. Once the strain relief 10 is attached to the rigid conduit, the greenfield does not rotate and is firmly secured to member 32. Thus, epoxy cement is optional in this embodiment.

It will be appreciated that in accordance with the principles of the invention, an improved lamp holder has been described for use with cold cathode fluorescent lamps. The lamp holder is provided as an assembly with the greenfield tubing and internal cable attached and ready for installation in the field using a few screws. The installation is rapid and provides enhanced safety for the electrical installer. The electrician merely attaches the other end of the cable remote of the lamp holder to an appropriate power source. When the system is energized the tubular member 32 provides acceptable free air space between the exposed greenfield and the internal live terminal. The cable is not exposed to the ambient atmosphere in the region adjacent to the lamp holder.

While the foregoing descriptions of the new and improved lamp holder for a cold cathode fluorescent lamp have been given as illustrations of several preferred embodiments of the invention, it is to be understood that certain variations will be apparent to those skilled in the art. Accordingly, the invention is to be limited only as set forth hereinafter in the appended claims.

What is claimed is:

1. A lamp holder for a cold cathode lamp having a pair of spaced electrodes, said lamp holder comprising:

a ceramic housing including a plurality of side walls and a bottom wall defining a cavity therein, one of said walls having an aperture therethrough;

an electrical contact in said cavity for electrically engaging one of said electrodes;

an electrically conductive terminal electrically connected to said electrical contact, said terminal having a terminal portion adapted to receive electrical wire; and a ceramic member secured to said one of said walls over said aperture and having a conduit dimensioned to receive and secure greenfield tubing therein, said ceramic member being dimensioned to mate with said one wall and to enclose said aperture, said conduit being in communication with said aperture such that a cable including an electrical wire contained within and extending from said greenfield tubing can extend into said cavity through said aperture for attachment to said terminal.

2. The lamp holder of claim 1 wherein the ceramic member is a tube.

3. The lamp holder of claim 1 wherein the ceramic member is secured to said one of said walls with an adhesive bonding medium.

4. The lamp holder of claim 1 wherein said member and conduit has a length sufficient to provide a free air spacer to preclude electrical shock hazard at the end of said conduit when said terminal receives a current of at least about 100 milliamps at 15 kv.

5. The lamp holder of claim 3 wherein the bonding medium is epoxy.

6. The lamp holder of claim 1 including a length of said greenfield tubing and a length of said cable each within said conduit and extending from said member, said cable including a wire having one end electrically connected to said terminal, said tubing being secured within said conduit to said member.

7. The lamp holder of claim 6 wherein said tubing is bonded to said member inside said conduit.

8. The lamp holder of claim 1 including a length of said greenfield tubing having a portion in said conduit, said portion being secured to said conduit and a strain relief secured to said tubing at an end of the tubing distal said member.

9. The lamp holder of claim 1 including an electrically insulating member in said cavity for dividing the cavity into two cavity compartment sections, said terminal being located in one of said two sections, at least the other of said two sections including said electrical contact forming a socket for receiving one of said electrodes of said lamp.

10. The lamp holder of claim 9 including a ceramic cap releasably secured to said housing over said one section.

11. The lamp holder of claim 1 wherein said housing includes ceramic flange means for securing said housing to a support.

12. The lamp holder of claim 1 wherein said member is tubular and extends from a side wall of said housing, said member including a length of said greenfield tubing extending through said conduit, said lamp holder including a strain relief secured to an extended end of said greenfield tubing, said member extending at least about 1.5 inches from said one of said walls, said strain relief having an extended end, said strain relief extended end being at least about 9 inches from the center of said housing.

13. A lamp holder for a cold cathode lamp having a pair of spaced electrodes, said lamp holder comprising:

a ceramic molded housing including a plurality of interconnected integral side walls and a bottom wall defining a cavity open to the ambient atmosphere in a region opposing said bottom wall, one of said walls having an aperture therethrough;

a resilient metal U-shaped contact in said cavity for releasably electrically receiving one of said electrodes, said contact forming a socket for slidably receiving said one electrode;

an insulating member secured to said housing in said cavity for dividing the cavity into two cavity sections;

an electrically conductive terminal in one section connected to said contact, said terminal having a portion adapted to receive an electrical wire in conductive contact, said terminal portion being adjacent to said aperture; and a tubular ceramic member secured to said one of said side walls over said aperture and having a conduit dimensioned to receive and secure a greenfield tubing therein, said member being dimensioned to mate with said one of said walls to enclose said aperture said conduit being in communication with said aperture such that a cable contained within and extending from said greenfield tubing projects into said cavity section through said aperture for electrical connection to said terminal portion.

14. The lamp holder of claim 13 including means associated with to said housing for securing a lamp safety cord to said housing to preclude lamp separation from said U-shaped contact.

15. The lamp holder of claim 14 including a ceramic cap over said one section, the other section forming a socket for said received one electrode.

16. The lamp holder of claim 13 including an adherent bonding medium for securing the tubular ceramic member to said one of said walls.

17. The lamp holder of claim 13 wherein said conduit has a length sufficient to preclude electrical shock hazard at the end of said conduit.

18. The lamp holder of claim 17 wherein the conduit has a diameter of about one half inch, the tubular ceramic member has a diameter of about 0.75 inches and a length of about one and one half inches.

19. The lamp holder of claim 18 including molded PVC greenfield tubing secured to said tubular member in said conduit and extending outwardly from said conduit.

* * * * *